United States Patent [19]

Brooking

[11] Patent Number: 4,993,715

[45] Date of Patent: Feb. 19, 1991

[54] APPARATUS FOR PLAYING A GAME OF SKILL

[76] Inventor: Terence M. Brooking, 15 Singleton Rd., Flynnlands 4052, Durban, South Africa

[21] Appl. No.: 380,975

[22] Filed: Jul. 17, 1989

[30] Foreign Application Priority Data

Jul. 15, 1988 [ZA] South Africa ..... 88/5107

[51] Int. Cl.[5] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 4,208,052 | 1/1980 | Snow | 273/153 S X |
| 4,484,744 | 11/1984 | Gmunder | 273/153 S |
| 4,506,891 | 3/1985 | Alexander et al. | 273/153 S |
| 4,522,402 | 6/1985 | Henry | 273/153 S |
| 4,575,088 | 3/1986 | Peek | 273/153 S |
| 4,723,776 | 2/1988 | Bean | 273/155 X |

FOREIGN PATENT DOCUMENTS

| | | | |
|---|---|---|---|
| 82/03792A | 4/1982 | PCT Int'l Appl. . | |
| 2088728A | 6/1982 | United Kingdom . | |
| 2107595 | 5/1983 | United Kingdom | 273/153 S |
| 2107997A | 5/1983 | United Kingdom . | |

*Primary Examiner*—Paul E. Shapiro
*Assistant Examiner*—Raleigh W. Chiu
*Attorney, Agent, or Firm*—Dann, Dorfman, Herrell & Skillman

[57] ABSTRACT

Apparatus 10 for playing a game of skill comprises a body 11 presenting a three-dimensional playing surface. There is provided on the surface at least one more possible position for a playing piece than playing pieces 25. The pieces 25 are therefore movable relative to one another by sliding them from position to position along grooves 16 and 24 to move them from a starting configuration on the surface to a predetermined eventual configuration on the surface.

12 Claims, 2 Drawing Sheets

APPARATUS FOR PLAYING A GAME OF SKILL

FIELD OF THE INVENTION

This invention relates to toys and more particularly it relates to apparatus for playing a game of skill.

BACKGROUND OF THE INVENTION

Applicant is aware of various versions of apparatus for playing games of skill comprising a board or tray having a flat playing surface and a plurality of disc-like playing pieces. The pieces are mounted on the surface such that a region of the surface, as large as at least some of the pieces, is not covered thereby. The object of these games is to slide pieces adjacent the uncovered region of the surface into that region thereby slidably to move the pieces on the surface relative to one another into a predetermined eventual configuration. These games, because of the two-dimensional playing surface, are all constrained to two-dimensional thinking.

SUMMARY OF THE INVENTION

It is an object of the present invention to provide alternative apparatus with which the applicant believes the aforementioned disadvantage will at least be alleviated.

According to the invention there is provided apparatus for playing a game comprising a three-dimensional body presenting a three-dimensional playing surface; and a plurality of playing pieces mounted on the body to be movable on the surface, the pieces being movable relative to one another so that they can be moved from a starting configuration on the surface to an eventual configuration on the surface.

In a preferred embodiment of the apparatus, there is provided on the surface one possible position for a playing piece more than the number of pieces so that a piece in the region of a vacant position may be moved into the vacant position thereby to move the pieces relative to one another.

The body may be in the form of a ball. An outer surface of the ball may be divided into twelve pentagonal regions separated by grooves wherein the playing pieces are slidable. The possible positions are provided in the grooves in corner regions where three pentagonal regions meet.

Each pentagonal region may be provided by a curved pentagonal element mounted on an inner support member.

The inner support member may comprise an inner ball and each element may comprise a base mounted on the inner ball to define a clearance between the inner ball and the element.

The apparatus preferably comprises a top element, a bottom element diametrically opposed to the top element, an upper row of five elements and a lower row of five elements between the top and bottom elements, a first ring of possible positions being defined between the top element and the upper row of elements, a second ring of positions being defined between the bottom element and the lower row of elements, a third ring of positions being defined between the upper and lower rows of elements towards the first ring and a fourth ring of positions being defined between the upper and lower rows of elements, but towards the second ring of positions.

A further groove may be provided in the top element extending from a further possible position in a centre region of the top element to a groove between adjacent elements.

Each playing piece may comprise a head, a disc-like foot and a neck joining the head and foot, the foot being located in the clearance and the neck extending outwardly through the groove.

In the preferred embodiment, there is provided twenty playing pieces divided into four sets of five pieces each. The heads of the pieces in each set are preferably commonly coloured, but different from those in the other sets.

The pieces in each set may further be numbered from one to five in that a numeral between one and five is printed on the head or on the side of each piece in each set.

The apparatus according to the invention may also comprise a handle mounted on the body. The handle is preferably secured to the bottom element.

The apparatus may further comprise an indicator mounted on the apparatus to give an indication of the eventual configuration of the pieces on the surface.

The indicator preferably is a colour indicator comprising a set of four discs mounted one on top of the other on the handle, the top disc being coloured similarly to the heads of the pieces to be located in the positions on the first ring, the bottom disc being coloured similarly to the heads of the pieces to be located in the positions on the second ring, the second from the top disc being coloured similarly to the heads of the pieces to be located in the positions on the third ring and the second from bottom disc being coloured similarly to the heads of the pieces to be located on the fourth ring.

BRIEF DESCRIPTION OF THE DRAWINGS

The invention will now further be described by way of example only, with reference to the accompanying drawings, wherein.

DESCRIPTION OF A PREFERRED EMBODIMENT

Figure 1:
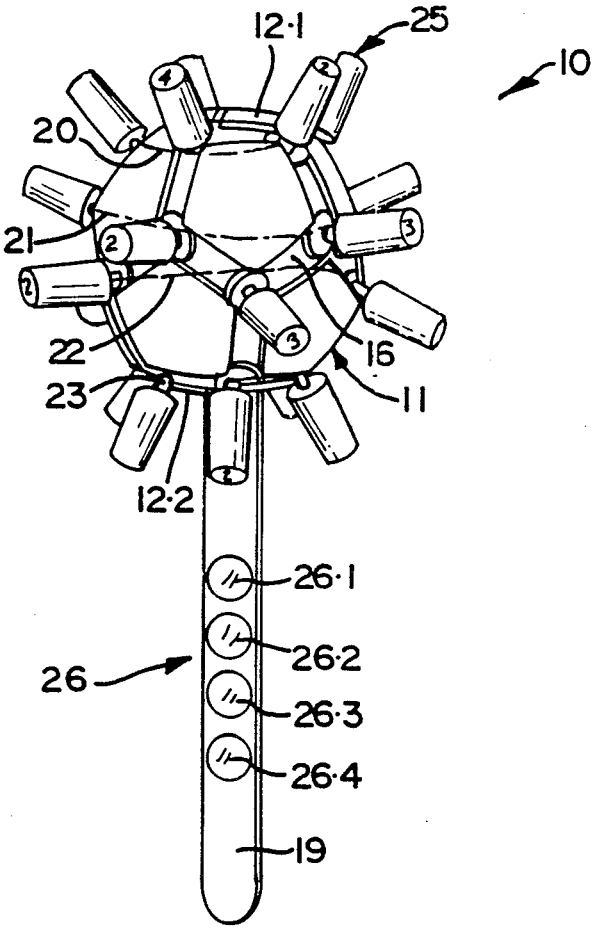
FIG. 1 is a diagrammatic side elevation of the apparatus according to the invention for playing a game.

The apparatus according to the invention for playing a game is generally designated by the reference numeral 10 in FIG. 1.

Figure 2:
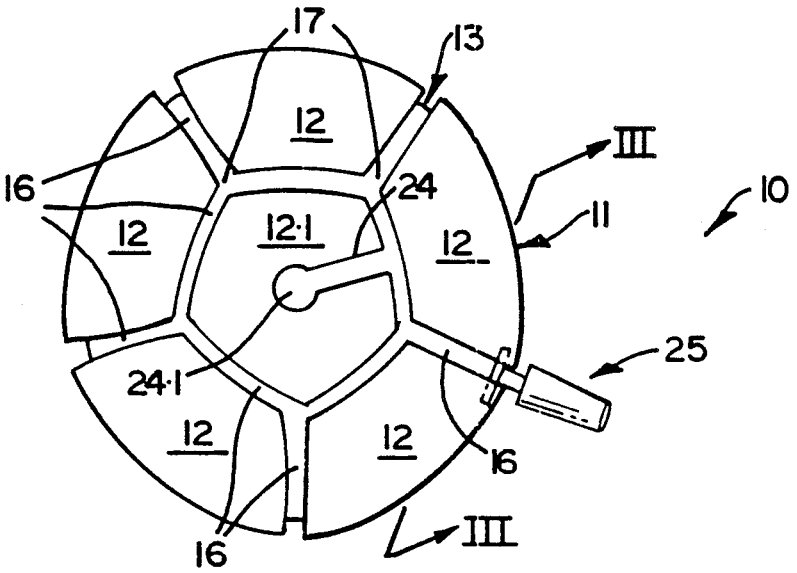
FIG. 2 is a diagrammatic top or plan view of the apparatus in FIG. 1 wherein most of the playing pieces have been left out for the sake of clarity.
Figure 3:
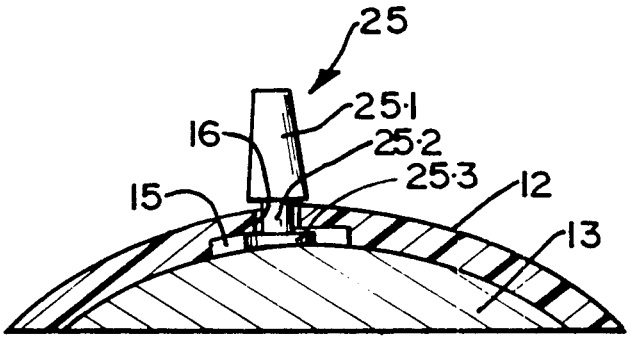
FIG. 3 is an enlarged section on line III in FIG. 2.

Referring to FIGS. 1 to 3, the apparatus comprises a three-dimensional body in the form of a ball 11, the outer surface of which is divided into twelve equidimensioned pentagonal regions. Each region is presented by a curved pentagonal element 12 mounted on an inner support in the form of a ball 13.

As best shown in FIG. 3, each element 12 is mounted on ball 13 by a base 14 to define a clearance 15 between ball 13 and the element. The elements 12 are spaced from one another so that grooves 16 are defined between the common sides of elements 12.

The ball has a top element 12.1, a bottom element 12.2 and an upper and a lower rows of elements between the said top and bottom elements. A handle 19 is secured to the bottom element 12.2.

The pentagonal elements meet in corner regions defining possible positions 17 for playing pieces 25. There are therefore provided five positions on a first or top ring of corners 20 in FIG. 1, five positions on a second or bottom ring of corners 23, five positions on a third ring of corners 21 and five positions on a fourth ring of corners 22.

As shown in FIG. 2, there is a groove 24 defined in top element 12.1. This groove 24 extends from a further possible position 24.1 in a centre region of the element to one of the positions on ring 20.

Figure 4:
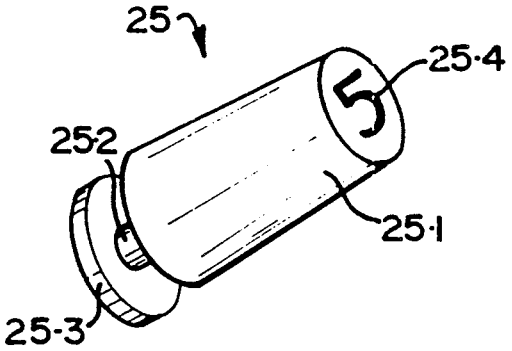
FIG. 4 is a perspective view of a stud-like playing piece forming part of the apparatus according to the invention.

Referring now also to FIG. 4, twenty playing pieces in the form of studs 25 are provided. Each stud comprises a head 25.1, a neck 25.2 and disc-like foot 25.3. As best shown in FIG. 3, the studs are mounted on the ball 11 with the feet located in the clearance 15 between ball 13 and two adjacent pentagonal elements. Necks 24.2 extend through grooves 16 and heads 25.3 are located radially outwardly of the pentagonal elements.

The studs 25 can be slid along the grooves 16 to move them from one corner region or position to another. The studs are also slidable along groove 24 to the centre position 24.1 in the top element 12.1.

The twenty studs are divided into four sets of five pieces each. A first set has blue heads, a second set has yellow heads, a third set has red heads and a fourth set has green heads. The heads of the studs in each set are also numbered from one to five by numerals 25.4 between one and five being printed on the heads or on the sides.

Referring now in particular to FIG. 1, a colour indicator 26 indicating the eventual positions of the studs on the ball 11 is provided on the handle 19. The indicator comprises four discs 26.1 to 26.4 coloured blue, yellow, red and green, respectively mounted one on top of the other on handle 19. This indicator therefore indicates that the eventual positions of the studs are as follows: the studs with the blue heads must be located in the positions on first ring 20, the studs with the yellow heads must be located in the positions on third ring 21, the studs with the red heads must be located in the positions on fourth ring 22 and the studs with the green heads must be located in the positions on second ring 23.

It will be appreciated that the twenty positions 17 on the aforementioned rings, as well as the extra centre position 24.1 in element 12.1, there is one more possible position than studs. The studs can thus be manipulated on the ball by a player until they are located in the aforementioned eventual positions. Furthermore, to present the player with a bigger challenge, the studs in each set should be positioned in numerical order.

It should be noted that the grooves 16 in the playing surface on the body provide three paths for movement of a stud 25 into or out of each of the positions 17. In the top and bottom rings 20 and 23, two paths interconnect with an adjoining position in the same ring and one path connects with a position in the adjoining intermediate ring 21 or 22. In the intermediate rings 21 and 22, two paths provided by the grooves 16 connect with positions in the other intermediate ring and one path connects with a position in the adjoining top or bottom ring. The groove 24, on the other hand, provides a single path connecting the inactivating position 24.1 with a path provided by one of the grooves 16 between adjoining positions in the top ring 20. The paths restrict displacement of the studs to movement along the surface of the three-dimensional body, and do not allow displacement of the stud away from the body, except at one of the positions 17 and 24.1, in the illustrated embodiment the inactivating position 24.1.

In the illustrated embodiment, the differing surface characteristics of the studs in each set of five pieces is achieved by providing different colours, and the differing indicia within each set are the numerals 1 through 5. If desired, the pieces may be differentiated by differing geometric configurations or other characteristics and/or by a sequence of other types of indicia.

It will be appreciated that there are many variations in detail possible on the apparatus according to the invention without departing from the scope and spirit of the appended claims.

I claim:

1. Apparatus for playing a game comprising a three-dimensional body in the form of a ball presenting a three-dimensional playing surface, the said playing surface being divided into twelve pentagonal regions separated by grooves, the said regions comprising a top region, a bottom region diametrically opposed to the top region, an upper row of five regions and a lower row of five regions, a first ring of five playing positions being defined by the grooves at the corners of the top pentagonal region between the said top pentagonal region and the said upper row of five regions, a second row of five playing positions being defined by the grooves at the corners of the bottom pentagonal region between the said bottom pentagonal region and the said lower row of five regions, a third ring of five playing positions being defined by the grooves at the corners between the upper and lower rows of regions but towards the first ring of playing positions and a fourth ring of five playing positions being defined by the grooves at the corners between the upper and lower row of regions, but towards the second ring of playing positions, one additional playing position being provided within a selected pentagonal region, a groove within this region leading from the said additional playing position to a groove extending between two of the playing positions at the corners of the said selected pentagonal region; and twenty playing pieces slidably located within the grooves of the body, the playing pieces being movable relative to one another between the playing positions, by virtue of the provision of the said additional playing position, between a starting configuration and a predetermined eventual configuration with respect to one another.

2. Apparatus according to claim 1 wherein said selected region is said top pentagonal region.

3. Apparatus as claimed in claim 1 wherein each pentagonal region is provided by a curved pentagonal element mounted on an inner support member.

4. Apparatus as claimed in claim 3 wherein the inner support member comprises an inner ball and wherein each element comprises a base mounted on the inner ball to define a clearance between the inner ball and the element.

5. Apparatus as claimed in claim 4 wherein each playing piece comprises a head, a disc-like foot and a neck joining the head and foot, the foot being located in the clearance and the neck extending outwardly through the groove.

6. Apparatus as claimed in claim 1 comprising a handle secured to the bottom element.

7. Apparatus as claimed in claim 1 wherein an indicator is provided on the apparatus to give an indication of the eventual configuration of the pieces on the surface.

8. Apparatus as claimed in claim 7 wherein the indicator is a colour indicator comprising a set of four discs mounted one on top of the other, the top disc being coloured similarly to the heads of the pieces to be located in the positions on the first ring, the bottom disc being coloured similarly to the heads of the pieces to be located in the positions on the second ring, the second from top disc being coloured similarly to the heads of the pieces to be located in the positions on the third ring and the second from bottom disc being coloured similarly to the heads of the pieces to be located on the fourth ring.

9. Apparatus as claimed in claim 1 wherein the twenty playing pieces are divided into four sets of five pieces each.

10. Apparatus as claimed in claim 9 wherein the heads of the pieces in each set have a common characteristic providing an indicator which is different from those in the other sets.

11. Apparatus as claimed in claim 9 wherein the pieces in each set have a sequence of indicia, and that one index of each sequence is printed on each piece in the set.

12. Apparatus as claimed in claim 1 comprising a handle mounted on the body.

* * * * *